US010449661B2

(12) United States Patent
Sekiguchi et al.

(10) Patent No.: US 10,449,661 B2
(45) Date of Patent: Oct. 22, 2019

(54) DRIVING TOOL

(71) Applicant: MAX CO., LTD., Chuo-ku, Tokyo (JP)

(72) Inventors: Norimichi Sekiguchi, Tokyo (JP); Hiroshi Tanaka, Tokyo (JP); Yasunori Aihara, Tokyo (JP); Michiaki Adachi, Tokyo (JP)

(73) Assignee: MAX CO., LTD., Tokyo (JP)

( * ) Notice: Subject to any disclaimer, the term of this patent is extended or adjusted under 35 U.S.C. 154(b) by 331 days.

(21) Appl. No.: 15/244,094

(22) Filed: Aug. 23, 2016

(65) Prior Publication Data

US 2017/0057068 A1 Mar. 2, 2017

(30) Foreign Application Priority Data

Aug. 24, 2015 (JP) ..... 2015-165108

(51) Int. Cl.
*B25C 1/04* (2006.01)

(52) U.S. Cl.
CPC ..... *B25C 1/042* (2013.01); *B25C 1/047* (2013.01)

(58) Field of Classification Search
CPC ... B23Q 11/0046; B23Q 11/0071; B25C 1/08; B25C 1/042; B25C 1/047
USPC ..... 227/9–11, 130; 123/527, 529, 585; 173/128
See application file for complete search history.

(56) References Cited

U.S. PATENT DOCUMENTS 3,735,824 A * 5/1973 Astrom ..... B23Q 1/015 175/213
5,205,457 A * 4/1993 Blomquist, Jr. ..... B25C 1/188 227/130
6,247,626 B1 * 6/2001 MacVicar ..... B25C 1/008 227/10
6,260,519 B1 * 7/2001 Phillips ..... B25C 1/005 123/46 R
6,626,081 B2 * 9/2003 Ho ..... B25C 1/042 227/130
6,834,789 B1 * 12/2004 Dion ..... B25C 1/042 227/130
7,040,520 B2 * 5/2006 Turk ..... B25C 1/08 227/10
7,703,651 B2 * 4/2010 Yamamoto ..... B25C 1/042 227/130

(Continued)

FOREIGN PATENT DOCUMENTS

EP A2-0747175 12/1996
JP 2006-055939 A 3/2006

OTHER PUBLICATIONS

Extended European Search Report dated Apr. 3, 2017 in corresponding European patent application 16001845.3 (7 pages).

*Primary Examiner* — Robert F Long
(74) *Attorney, Agent, or Firm* — Rothwell, Figg, Ernst & Manbeck, P.C.

(57) ABSTRACT

A driving tool includes a driver configured to drive out a fastener, a piston to which the driver is connected, a cylinder in which the piston is disposed so as to be reciprocated, a head valve which is slidably mounted and controls flow of compressed air into the cylinder, and a foreign matter removing member provided with a protruding portion facing a circumferential surface of the head valve. When the head valve slides to move relatively with respect to the foreign matter removing member, a matter attached on the circumferential surface of the head valve can be removed by the protruding portion.

13 Claims, 8 Drawing Sheets

(56) References Cited

U.S. PATENT DOCUMENTS

| | | | | |
|---|---|---|---|---|
| 2007/0034395 | A1* | 2/2007 | Glaser | B44B 5/00 173/30 |
| 2008/0023519 | A1 | 1/2008 | Aihara | |
| 2008/0190988 | A1* | 8/2008 | Pedicini | B25C 1/04 227/130 |
| 2009/0090759 | A1 | 4/2009 | Leimbach et al. | |
| 2010/0230461 | A1* | 9/2010 | Tanaka | B25C 1/08 227/9 |
| 2011/0024991 | A1* | 2/2011 | Capellmann | F16J 15/0806 277/592 |
| 2015/0075833 | A1* | 3/2015 | Dotan | B23Q 5/06 173/218 |
| 2015/0197001 | A1* | 7/2015 | Li | B25C 1/047 227/130 |

* cited by examiner

DRIVING TOOL

CROSS-REFERENCE TO RELATED APPLICATION

This application claims priorities from Japanese Patent Application No. 2015-165108 filed on Aug. 24, 2015, the entire contents of which are incorporated herein by reference.

FIELD

The present disclosure relates to a driving tool which operates a piston by compressed air to drive out a fastener, and particularly to a technology for preventing a foreign matter from entering an O-ring groove and the like of a head valve.

BACKGROUND

Such a kind of driving tool includes a head valve which controls flow of compressed air into a cylinder. When a trigger of the driving tool is manipulated, the head valve slides so that the compressed air flows into the cylinder to operate a piston, and a fastener is driven.

When a nailing work is performed, an ambient temperature of the head valve is decreased by an adiabatic expansion of the compressed air which passes through the head valve. Particularly, when the nailing work is continuously performed under an environment of low temperature and high humidity, water contained in the compressed air may be frozen by fall of temperature due to the adiabatic expansion. When an ice grain generated in such a manner is attached to the head valve, the ice grain grows gradually to be deposited in the vicinity of an O ring of the surface of the head valve, or to be caught in the O-ring groove. When the ice grain is caught in the O-ring groove to suppress the deformation of the O ring, a slide resistance of the head valve is increased so that sliding cannot be performed smoothly. When the head valve cannot smoothly slide, it results in the power-down of the driving tool or the increase of an air consumption amount.

A technology relating thereto is disclosed, for example, in Japanese Unexamined Patent Application Publication (JP-A) No. 2006-55939 in which the description is given about a configuration in which a ring-shaped flange portion is formed to protrude from an outer circumferential surface apart from an upper end edge of the strike cylinder, the cylinder seal formed of a material having a large heat insulating property and an elasticity is mounted to cover the surfaces of the upper surface of the ring-shaped flange portion and the upper end portion of the strike cylinder from the upper surface of the ring-shaped flange portion to the upper end portion of the strike cylinder, and a piston stop damping the strike piston at an upper dead center position and having a large heat insulating property and an elasticity is disposed on an upper side of the strike cylinder.

With such a configuration, although freezing occurs in the water of the compressed air by the adiabatic expansion of the compressed air, freezing water is hardly attached to the rubber having a large heat insulating property and an excellent elasticity, and although attached, the freezing water is easy to peel off so as to be easily blown away by the compressed air. Therefore, it is preferably prevented that the supply passage and the discharge passage of the compressed air are frozen.

In the technology described in JP-A-2006-55939, however, since a direct countermeasure is not implemented against freezing of a valve such as the head valve, the attachment of the ice on the surface can be prevented, but it cannot be prevented that the ice grain enters the O-ring groove, and the slide resistance is increased.

In this regard, an object of the disclosure is to provide a driving tool which can prevent a foreign matter such as ice from entering a sealed portion (O-ring groove and the like) of the head valve.

SUMMARY

The disclosure is made to resolve the above-described problem, and has the following features.

An aspect of the disclosure is to provide a driving tool including:

a driver configured to drive out a fastener;

a piston to which the driver is connected;

a cylinder in which the piston is disposed so as to be reciprocated;

a head valve which is slidably mounted and controls flow of compressed air into the cylinder; and a foreign matter removing member provided with a protruding portion facing a circumferential surface of the head valve;

wherein when the head valve slides to move relatively with respect to the foreign matter removing member, a matter attached on the circumferential surface of the head valve can be removed by the protruding portion.

The foreign matter removing member may have a notch portion for preventing formation of an air seal between the foreign matter removing member and the head valve.

The protruding portion may obliquely contact with the circumferential surface of the head valve.

The protruding portion may be formed to be thinner as it goes toward a tip of the protruding portion.

According to the driving tool of the aspect of the disclosure as described above, the foreign matter removing member is provided with the protruding portion facing the circumferential surface of the head valve. For this reason, a sealed portion (O-ring groove and the like) is covered with the foreign matter removing member so that it can be prevented that the foreign matter such as ice enters the sealed portion.

When the head valve slides to move relatively with respect to the foreign matter removing member, the matter attached on the circumferential surface of the head valve can be removed by the protruding portion, and thus the ice attached on the circumferential surface of the head valve is chipped off by the foreign matter removing member. Accordingly, when the head valve slides, the ice is not involved and caught therein.

According to the driving tool of the disclosure as described above, the foreign matter removing member has the notch portion for preventing the formation of the air seal between the foreign matter removing member and the head valve. With such a configuration, the air pressure difference is not generated between the inside and the outside of the foreign matter removing member, and thus an unnecessary load is not generated in the foreign matter removing member.

According to the driving tool of the disclosure as described above, the protruding portion obliquely contacts with the circumferential surface of the head valve. With such a configuration, an effect to chip off the ice when the head valve is slid can be easily exhibited, and the protruding portion can be hardly involved.

According to the driving tool of the disclosure as described above, the protruding portion is formed to be thinner as it goes toward the tip thereof. With such a configuration, the protruding portion is easy to bend, and thus the slide resistance of the head valve in operating is hardly increased.

BRIEF DESCRIPTION OF DRAWINGS

FIG. 4 is an enlarged sectional view illustrating the driving tool in a state where the trigger is set on.

DETAILED DESCRIPTION

An embodiment of the invention will be described with reference to the drawings.

Figure 1:
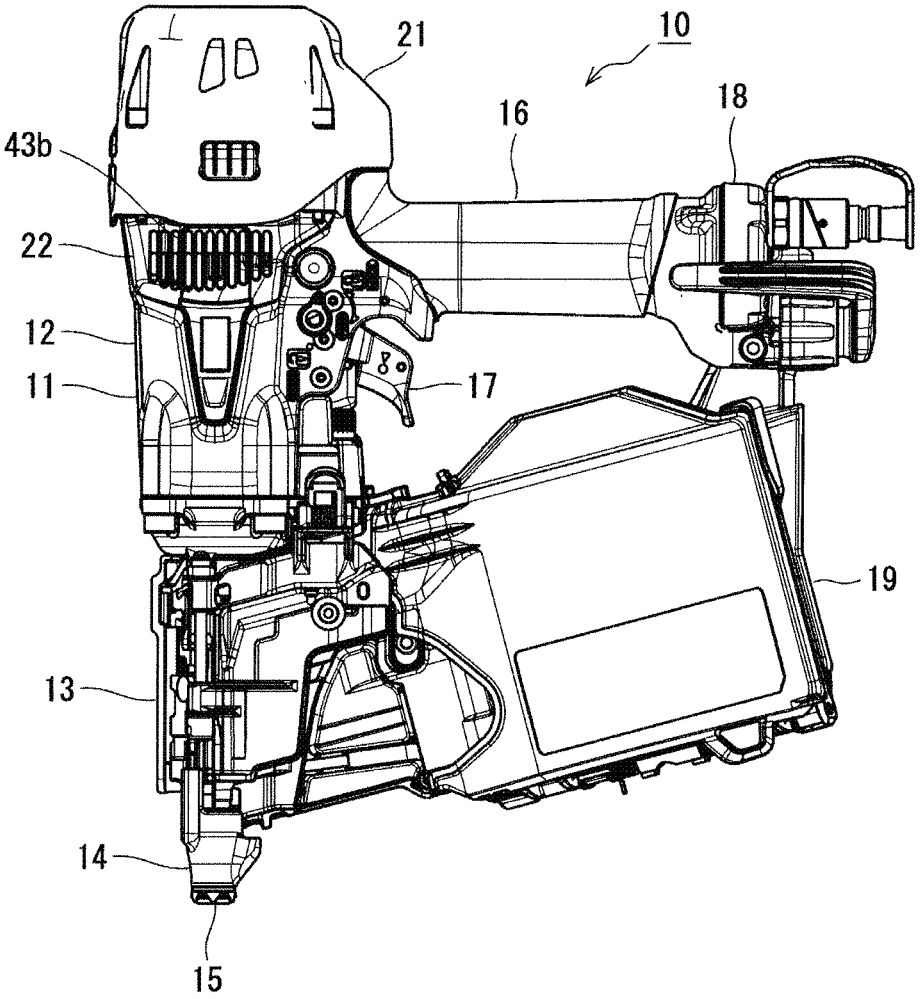
FIG. 1 is a side view illustrating a driving tool.

A driving tool 10 according to this embodiment is a pneumatic driving tool 10 which drives a fastener using compressed air. As illustrated in FIG. 1, the driving tool includes a tool main body 11 having a nose portion 13 and a magazine 19 connected to the tool main body 11. A connection fastener is contained in the magazine 19, and the connection fastener is pulled out in a direction of the nose portion 13 and used for driving.

Figure 2:
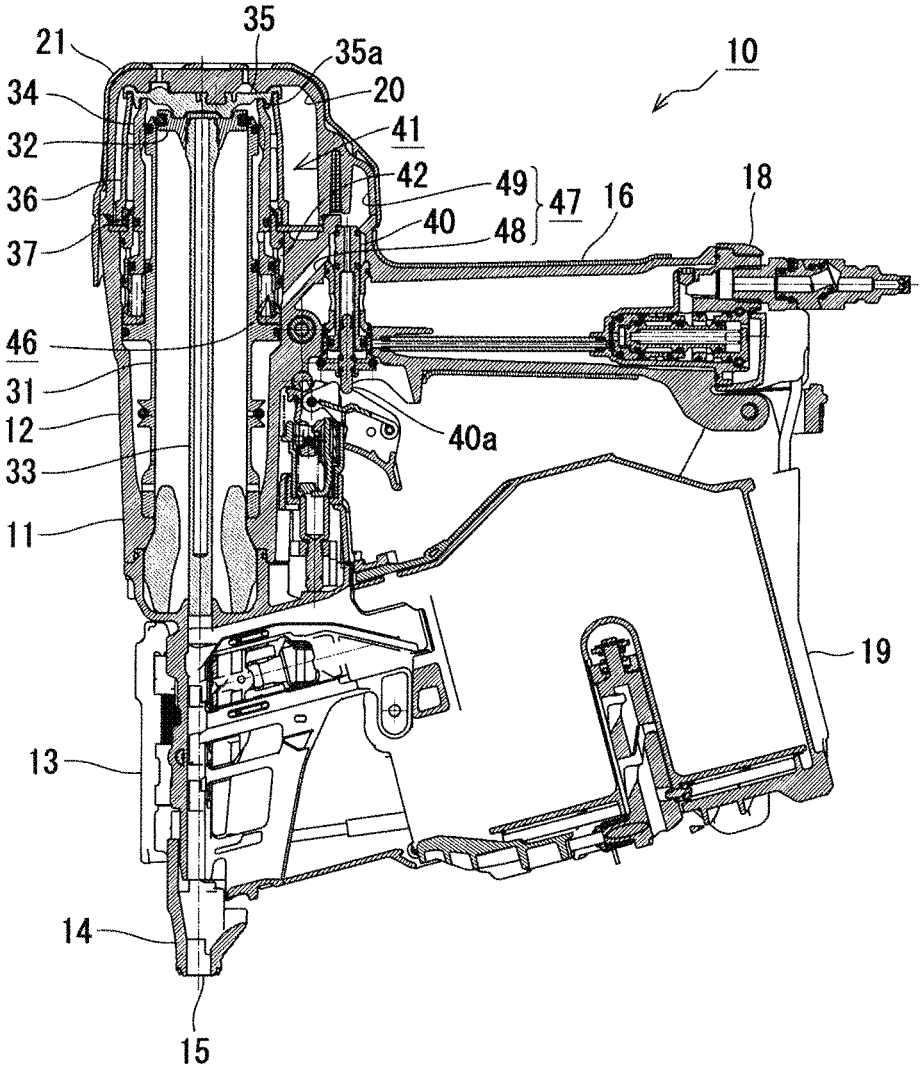
FIG. 2 is a sectional view illustrating the driving tool.

As illustrated in FIGS. 1 and 2, the tool main body 11 includes a body housing 12, a grip housing 16 connected to the body housing 12 at a substantially perpendicular angle, the nose portion 13 integrally fixed to the front end side (a driving direction of the fastener) of the body housing 12, and a cap housing 20 integrally fixed to the rear end side (an opposite direction to the driving direction of the fastener) of the body housing 12.

As illustrated in FIG. 2, a cylinder 31 is disposed inside the body housing 12 and the cap housing 20, and a piston 32 is contained in the cylinder 31 so as to be reciprocated. A driver 33 for striking the fastener is coupled with the lower surface of the piston 32. When the piston 32 is operated by the pneumatic pressure of the compressed air, the driver 33 is moved downward integrally with the piston 32 to drive the fastener. The compressed air for operating the piston 32 is supplied from an external device such as an air compressor. Such an external device is connected to an end cap portion 18 provided in a rear end of the grip housing 16. The compressed air supplied from the external device can pass into the grip housing 16 and be supplied to the cylinder 31.

The nose portion 13 is provided to inject the fastener, and the above-described driver 33 is guided to be slidable in the direction of the nose portion 13. A fastener supply mechanism is provided on the rear side of the nose portion 13. The feeding operation of the fastener supply mechanism is executed in conjunction with the driving operation. The fastener contained in the magazine 19 is fed to the nose portion 13 through the feeding operation.

A contact portion 14 pushed against a target material to be driven is mounted in the tip of the nose portion 13 so as to be slidable on the nose portion 13. The contact portion 14 is slid upward on the nose portion 13 when pushed against the target material to be driven, and such a slide of the contact portion 14 causes a safety mechanism of the driving operation to operate. While not describing the well-known safety mechanism in detail, the operation of the safety mechanism enables to manipulate a trigger 17 provided with the grip housing 16 and to drive the fastener.

When the trigger 17 is manipulated in a state where the contact portion 14 is pushed against the target material to be driven (otherwise, when the contact portion 14 is pushed against the target material to be driven in a state where the trigger 17 is manipulated), the compressed air supplied from the external device flows into the cylinder 31, and the compressed air acts on the piston 32 to run the piston 32. The piston 32 runs so that the driver 33 coupled to the piston 32 strikes a first fastener, and the fastener is driven out.

An injection port 15 through which the fastener is driven out is formed at the tip of the contact portion 14, and the inner circumferential surface of the contact portion 14 until the injection port 15 forms an injection passage of the fastener. When the fastener is driven out, the driver 33 and the fastener are guided with a stable posture by the inner circumferential surface of the contact portion 14.

The configuration of the above-described driving operation will be described further in detail.

Figure 3:
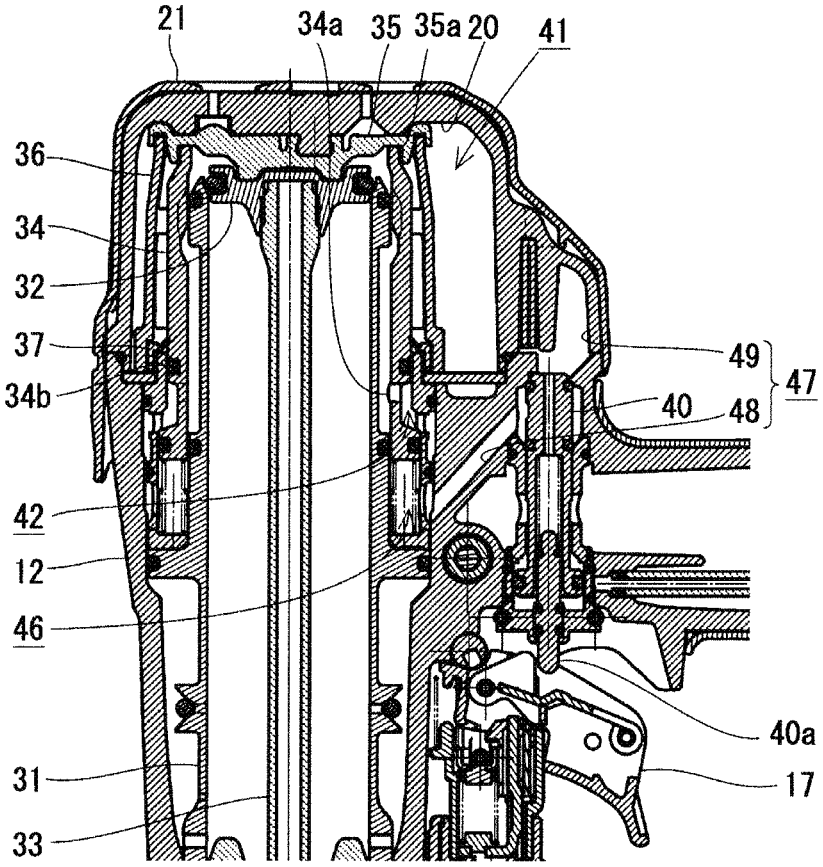
FIG. 3 is an enlarged sectional view illustrating the driving tool, and illustrates a state where a trigger is set off.

As illustrated in FIG. 3, the driving tool 10 according to this embodiment inwardly includes a head valve 34 which controls the flow of the compressed air into the cylinder 31, a piston stop 35 which stops the piston 32 at a top dead point, a cylindrical guide 36 which supports the circumferential edge of the piston stop 35, a foreign matter removing member 37 which is fixed by the cylindrical guide 36, a main chamber 41 which stores the compressed air for biasing the piston 32, a main exhaust passage 42 configured to discharges the compressed air flowing into the cylinder 31 to the outside, a head valve chamber 46 which stores the compressed air for biasing the head valve 34, a sub exhaust passage 47 configured to discharge the compressed air stored in the head valve chamber 46 to the outside, and a pilot valve 40 configured to open and close the head valve chamber 46 to an atmosphere side.

The head valve 34 is a cylindrical member disposed on the outside of the cylinder 31, and is slidable in an axial direction to the cylinder 31. As illustrated in FIG. 3, the head valve 34 is pushed upward by the compressed air stored in the head valve chamber 46 and a compression spring in a state where the pilot valve 40 is not operated (in a state where the trigger 17 is not manipulated). At this time, the force of pushing downward by the compressed air of the main chamber 41 acts on the head valve 34. However, since an area where the compressed air acts on the head valve chamber 46 side is larger than that on the main chamber 41 side, the head valve 34 is pushed upward by the differential pressure. The upper end edge of the head valve 34 pushed upward abuts against a seal portion 35*a* provided in the piston stop 35 so that the circumference of the cylinder 31 is sealed. Accordingly, the compressed air of the main chamber 41 does not flow into the cylinder 31 by the sealing.

Figure 4:
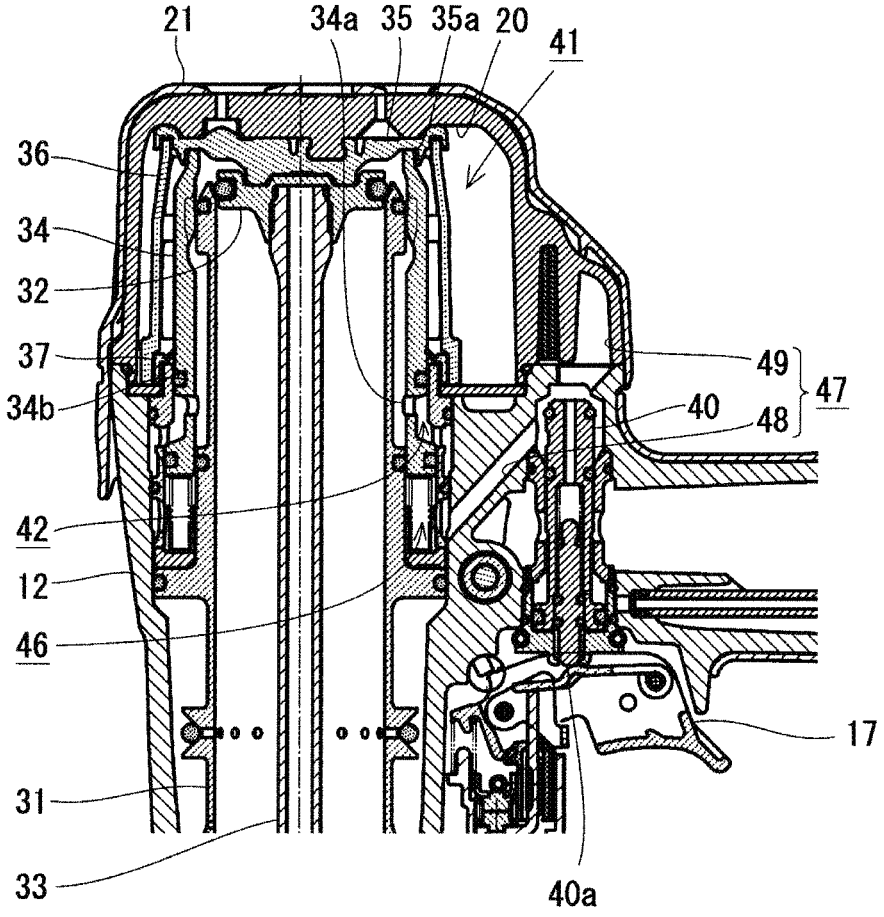
Figure 5:
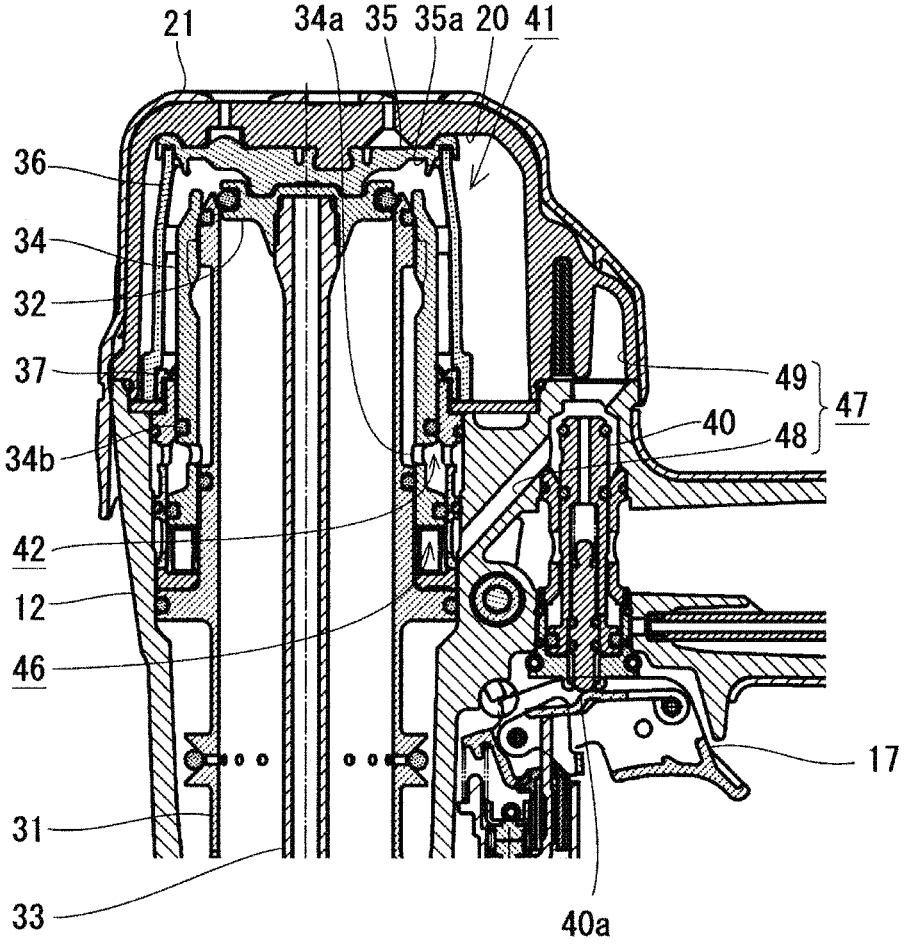
FIG. 5 is an enlarged sectional view illustrating the driving tool in a state where a head valve is operated.

On the other hand, as illustrated in FIG. 4, when the sub exhaust passage 47 is opened in a state where the pilot valve 40 is operated, the compressed air stored in the head valve chamber 46 is discharged to the outside, and the compressed air pushing the head valve 34 upward is discharged to the outside. For this reason, as illustrated in FIG. 5, the head valve 34 is pushed downward by the compressed air of the main chamber 41. When the head valve 34 is moved downward to operate, the sealed state between the head valve 34 and the seal portion 35*a* is released so that the compressed air of the main chamber 41 flows into the cylinder 31 to run the piston 32.

The piston stop 35 is configured to receive and stop the piston 32 moved to the top dead point, and is fixed on a ceiling portion of the cap housing 20. The piston stop 35 is formed, for example, of an elastic material such as rubber in order to receive an impact of the piston 32. The seal portion 35*a* configured to seal the circumference of the cylinder 31 by being coupled with the head valve 34 is formed in the vicinity of the outer circumferential edge of the piston stop 35.

The cylindrical guide 36 is a member for supporting the vicinity of the outer circumferential edge of the piston stop 35, and supports the substantially outer circumferential side of the seal portion 35*a* to prevent the piston stop 35 from being hung down. The cylindrical guide 36 is not intended for the sealing of the compressed air, and thus a plurality of vent holes are drilled in the outer circumference thereof.

The main chamber 41 is a space configured to store the compressed air supplied from the external device such as the compressor. The main chamber 41 always receives the compressed air from the external device connected to the end cap portion 18.

The main exhaust passage 42 discharges the compressed air in the cylinder 31 to the outside. In this embodiment, the main exhaust passage 42 is provided to communicate with an exhaust hole 34*a* formed in the outer circumference of the head valve 34. Accordingly, the compressed air in the cylinder 31 is introduced to the main exhaust passage 42 through the exhaust hole 34*a* of the head valve 34, and is discharged to the outside. A main exhaust chamber (not illustrated) configured to reduce the pressure of the compressed air is provided on the main exhaust passage 42. The main exhaust chamber is formed by covering the side portion of the body housing 12 with a resin cover 22. A plurality of slits illustrated in FIG. 1 are provided on the surface of the resin cover 22, and the slit forms a discharge port 43*b* configured to discharge the compressed air of the main exhaust chamber to the outside.

The head valve chamber 46 is a space configured to store the compressed air for biasing the head valve 34 to a stand-by state. The head valve chamber 46 is configured to open and close to external air and the main chamber 41 by the pilot valve 40. That is, as illustrated in FIG. 3, in a state where the pilot valve 40 is not operated, the head valve chamber 46 communicates with the main chamber 41, and stores the compressed air supplied from the compressor and the like. At this time, the head valve chamber 46 is in the state of being closed to the external air.

On the other hand, as illustrated in FIG. 4, in a state where the pilot valve 40 is operated, the head valve chamber 46 is opened to the atmosphere, and thus the compressed air of the head valve chamber 46 is discharged. At this time, the head valve chamber 46 and the main chamber 41 are blocked by the seal structure (0 ring) provided in the pilot valve 40, and thus the compressed air of the main chamber 41 is not discharged.

The sub exhaust passage 47 is configured to discharge the compressed air of the head valve chamber 46 to the outside. The sub exhaust passage 47 is not connected to the above-described main exhaust passage 42, and is provided independently from the main exhaust passage 42.

The sub exhaust passage 47 includes a sub exhaust duct 48 connected to the head valve chamber 46, and a sub exhaust chamber 49 provided in the downstream of the sub exhaust duct 48. The sub exhaust duct 48 and the sub exhaust chamber 49 are openable and closable by the pilot valve 40.

As illustrated in FIGS. 6A to 6D, the foreign matter removing member 37 is a ring-shaped member, and is formed of an elastic material such as resin or rubber. The foreign matter removing member 37 according to this embodiment includes a short cylindrical portion 37*a*, and a protruding portion 37*c* formed to protrude from the upper end edge of the short cylindrical portion 37*a* in an inner circumferential direction. As illustrated in FIGS. 7A and 7B, the foreign matter removing member 37 is fixed to the housing so as to avoid moving with respect to the housing by pushing the short cylindrical portion 37*a* with the above-described cylindrical guide 36.

At this time, the protruding portion 37*c* contacts with the circumferential surface of a head valve 34. For this reason, when the head valve 34 is slid, the protruding portion 37*c* acts to rub the circumferential surface of the head valve 34, and thus ice 50 and the like attached to the surface of the head valve 34 can be chipped off.

A groove portion 37*d* is formed on the upper surface between the short cylindrical portion 37*a* and the protruding portion 37*c*. By forming the groove portion 37*d*, the ice 50 chipped off by the protruding portion 37*c* can be captured on the upper surface of the foreign matter removing member 37.

A notch portion 37*b* is provided in the inner circumference of the short cylindrical portion 37*a* so as to avoid forming an air seal between the short cylindrical portion and the head valve 34. That is, as illustrated in FIGS. 7A and 7B, a space S is formed on the inner side of the protruding portion 37*c* between the protruding portion and the head valve 34. However, the space S does not become to an airtight state by providing the notch portion 37*b*. With such a configuration, an air pressure difference is not generated on the inside and the outside of the foreign matter removing member 37, and thus an unnecessary load is not generated in the foreign matter removing member 37.

The foreign matter removing member 37 is mounted so as to cover a sealed portion 34*b* of the head valve 34. In this embodiment, the foreign matter removing member is mounted so as to the supply passage side rather than the sealed portion 34*b* of the head valve 34. The sealed portion 34*b* of the head valve 34 is a portion for blocking the supply passage side (main chamber 41 side) to a cylinder 31 and the exhaust passage side (main exhaust passage 42 side) from the cylinder 31. In this embodiment, as illustrated in FIGS.

7A and 7B, the O-ring groove 34*d* is provided on the circumferential surface of the head valve 34, and the sealed portion 34*b* is formed by mounting a seal member (e.g. an O ring 34*c*) to the O-ring groove 34*d*. The ice 50 attached to the circumferential surface of the head valve 34 can be efficiently removed by mounting the foreign matter removing member 37 on the supply passage side.

That is, when the head valve 34 slides in a state where the ice 50 is attached on the supply passage side as illustrated in FIG. 7A, the tip of the protruding portion 37*c* acts to rub the circumferential surface of the head valve 34 so as to remove the ice 50 as illustrated in FIG. 7B.

Figure 8A:
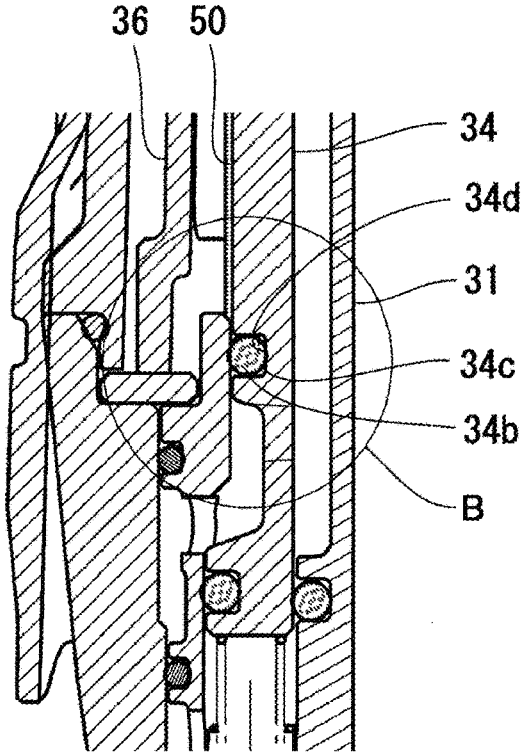
FIG. 8A is diagram illustrating a function in a case where the foreign matter removing member is not provided and illustrating a state where ice is caught in a sealed portion of the head valve.
Figure 8B:
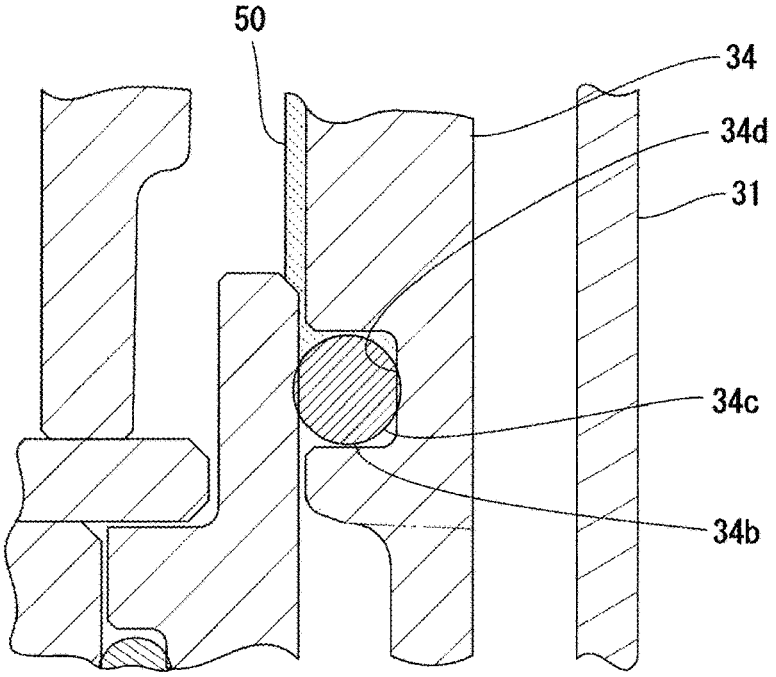
FIG. 8B is diagram illustrating a function in a case where the foreign matter removing member is not provided and is a further enlarged diagram illustrating a B portion of FIG. 8A.

As illustrated in FIGS. 8A and 8B, in a case where the foreign matter removing member 37 is not provided, the ice 50 is caught in the sealed portion 34*b* (O-ring groove 34*d* and the like) of the head valve 34. When the ice 50 is caught in the O-ring groove 34*d* as above, the deformation of the O ring 34*c* is suppressed so that the slide resistance of the head valve 34 at the time of sliding is increased. When the head valve 34 cannot smoothly slid as above, it results in the power down of the driving tool 10 or the increase of the air consumption amount. In this regard, when the above-described foreign matter removing member 37 is used, it can be prevented that the ice 50 is caught in the sealed portion 34*b*, and the ice 50 attached on the circumferential surface of the head valve 34 grows.

As illustrated in FIGS. 7A and 7B, the protruding portion 37*c* obliquely contacts with the circumferential surface of the head valve 34. Specifically, the protruding portion 37*c* extends obliquely in a direction of separating from the sealed portion 34*b* (upward in FIGS. 7A and 7B) as it goes toward the tip part thereof when viewed in an axial direction of the head valve 34. With such a configuration, an effect to chip off the ice 50 when the head valve 34 is slid can be easily exhibited, and the protruding portion 37*c* can be hardly involved.

Figure 6A:
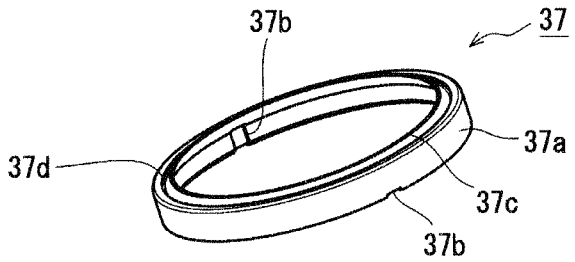
FIG. 6A is a perspective view illustrating the appearance of a foreign matter removing member.
Figure 6B:
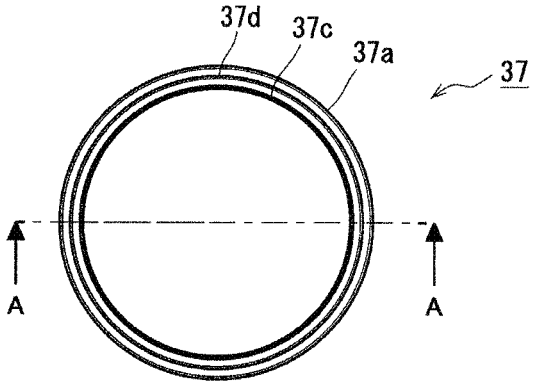
FIG. 6B is a plan view illustrating the foreign matter removing member.
Figure 6C:
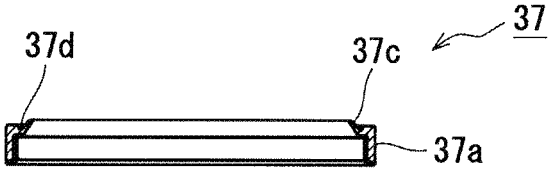
FIG. 6C is a sectional view illustrating the foreign matter removing member when taken along line A-A of FIG. 6B.
Figure 6D:
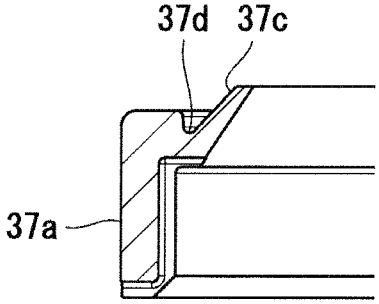
FIG. 6D is an enlarged sectional view partially illustrating the foreign matter removing member when taken along line A-A of FIG. 6B.
Figure 7A:
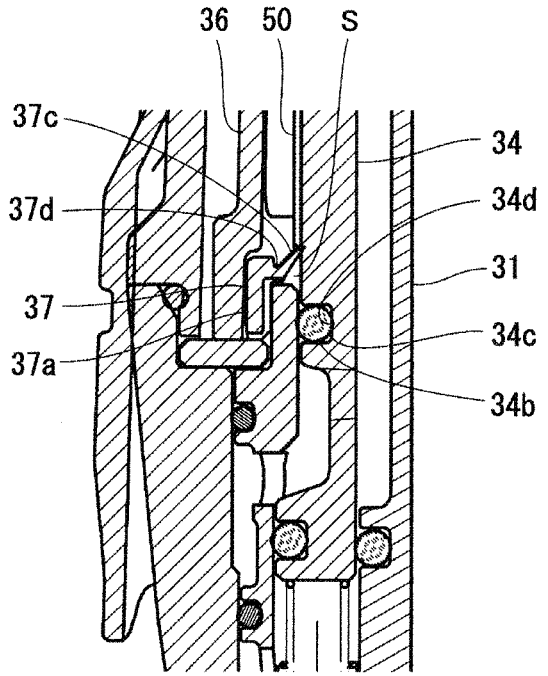
FIG. 7A is diagram illustrating a function of the foreign matter removing member and illustrating a state before the head valve is operated.
Figure 7B:
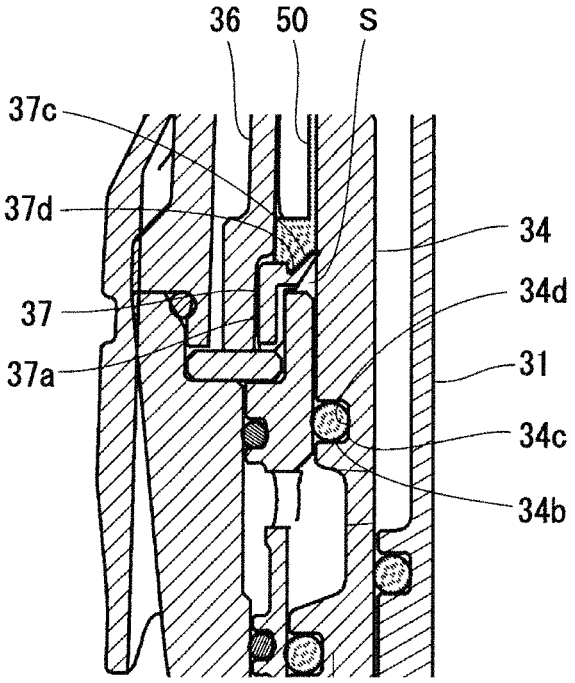
FIG. 7B is diagram illustrating a function of the foreign matter removing member and illustrating a state after the head valve is operated.

As illustrated in FIG. 6D, the protruding portion 37*c* is formed to be thinner as it goes toward the tip thereof. With such a configuration, the protruding portion 37*c* is easy to bend, and thus the slide resistance of the head valve 34 at the time of operating is hardly increased.

As described above, in this embodiment, the protruding portion 37*c* contacting with the circumferential surface of the head valve 34 is provided to the foreign matter removing member 37. For this reason, the sealed portion 34*b* is covered with the foreign matter removing member 37 so that it can be prevented that the foreign matter such as the ice 50 enters the sealed portion 34*b*.

When the head valve 34 slides, the protruding portion 37*c* acts to rub the circumferential surface of the head valve 34, and thus the ice 50 attached on the circumferential surface of the head valve 34 is chipped off by the foreign matter removing member 37. Accordingly, when the head valve 34 slides, the ice 50 is not involved and caught therein.

In the above-described embodiment, the protruding portion 37*c* contacts with the circumferential surface of the head valve 34. However, the invention is not limited thereto, a gap may be provided between the protruding portion 37*c* and the circumferential surface of the head valve 34, and the protruding portion 37*c* may not contact with the circumferential surface of the head valve 34. Even in a case where the gap is provided as above, it can be prevented that a large amount of the ice 50 is attached to affect the sliding, and thus a certain effect can be obtained.

In the above-described embodiment, the protruding portion 37*c* is provided in the entire circumference of the foreign matter removing member 37. However, the invention is not limited thereto, and the protruding portion 37*c* may be partially provided according to a passage of the compressed air.

In the above-described embodiment, the description is given about removing the foreign matter in the head valve 34. However, the invention is not limited thereto, and the invention may be applied to another portion which is provided to be slidable.

The invention claimed is:

1. A driving tool comprising:

a driver configured to drive out a fastener;

a piston to which the driver is connected;

a cylinder in which the piston is disposed so as to be reciprocated;

a head valve which is disposed on an outside of the cylinder, which is slidably mounted to move in an axial direction relative to the cylinder and which controls flow of compressed air into the cylinder, wherein the head valve includes a sealed portion on a circumferential surface of the head valve; and a foreign matter removing member disposed at a position opposed to the circumferential surface of the head valve, wherein the foreign matter removing member includes a tip portion;

wherein the tip portion of the foreign matter removing member contacts with the circumferential surface of the head valve and the foreign matter removing member is disposed so as to cover the sealed portion which is provided on the circumferential surface of the head valve, and wherein the head valve moves relative to the foreign matter removing member to provide relative movement between the circumferential surface of the head valve and the foreign matter removing member by sliding of the head valve.

2. The driving tool according to claim 1, wherein the foreign matter removing member comprises a protruding portion facing the circumferential surface of the head valve, and the protruding portion includes the tip portion, and wherein the foreign matter removing member has a notch portion for preventing formation of an air seal between the foreign matter removing member and the head valve.

3. The driving tool according to claim 1, wherein the foreign matter removing member comprises a protruding portion facing the circumferential surface of the head valve, and the protruding portion includes the tip portion, and wherein the tip portion of the protruding portion obliquely contacts with the circumferential surface of the head valve.

4. The driving tool according to claim 2, wherein the tip portion of the protruding portion obliquely contacts with the circumferential surface of the head valve.

5. The driving tool according to claim 1, wherein the foreign matter removing member comprises a protruding portion facing the circumferential surface of the head valve, and the protruding portion include the tip portion, and wherein the protruding portion is tapered so as to be thinner toward the tip portion of the protruding portion.

6. The driving tool according to claim 2, wherein the protruding portion is tapered so as to be thinner toward the tip portion of the protruding portion.

7. The driving tool according to claim 3, wherein the protruding portion is tapered so as to be thinner toward the tip portion of the protruding portion.

8. The driving tool according to claim 4, wherein the protruding portion is tapered so as to be thinner toward the tip portion of the protruding portion.

9. The driving tool according to claim 1, wherein the foreign matter removing member comprises:

a cylindrical portion which extends around the head valve; and a protruding portion extending radially inwardly from the cylindrical portion, and wherein the protruding portion includes the tip portion at an end thereof.

10. The driving tool according to claim 9, wherein the driving tool includes a housing, and the foreign matter removing member is fixed relative to said housing.

11. The driving tool according to claim 1, wherein the driving tool includes a housing, and the foreign matter removing member is fixed relative to said housing.

12. The driving tool of claim 10, wherein the head valve is movably mounted with respect to the housing.

13. The driving tool of claim 11, wherein the head valve is movably mounted with respect to the housing.

* * * * *